US006046661A

United States Patent [19]

Reger et al.

[11] Patent Number: 6,046,661

[45] Date of Patent: Apr. 4, 2000

[54] ELECTRICAL SWITCHING DEVICE

[75] Inventors: Arno Reger, Deilingen; Rainer Schmelz, Rottweil, both of Germany

[73] Assignee: Gruner Aktiengesellschaft, Wehingen, Germany

[21] Appl. No.: 09/045,845

[22] Filed: Mar. 23, 1998

[30] Foreign Application Priority Data

Apr. 12, 1997 [DE] Germany ..... 197 15 261

[51] Int. Cl.[7] ..... H01H 3/00

[52] U.S. Cl. ..... 335/185; 335/185

[58] Field of Search ..... 335/78–86, 121, 335/124, 128, 177–179, 185–190

[56] References Cited

U.S. PATENT DOCUMENTS 4,430,579 2/1984 Wiktor .

FOREIGN PATENT DOCUMENTS 4013840 10/1991 Germany .

9320696 1/1995 Germany .

*Primary Examiner*—Lincoln Donovan

*Attorney, Agent, or Firm*—Paul Vincent

[57] ABSTRACT

A device (11*a*; 11*b*) for switching an electrical circuit has a contact element (15*a*; 15*b*) which closes or opens the circuit between a first and a second terminal (13*a*, 14*a*; 13*b*, 14*b*). One end of the contact element (15*a*; 15*b*) is connected to the first terminal in a conducting fashion (13*a*; 13*b*). The second free end of the contact element (15*a*; 15*b*) closes the circuit in a first end position and opens the circuit in a second end position. A switchable magnetic field, preferably one whose polarity can be changed, moves, by means of an actuator device, the contact element (15*a*; 15*b*) into one of its two end positions. The activating device comprises a toggle lever (23*a*; 23*b*) to move the free end of the contact element (15*a*; 15*b*) into at least one of its two end positions. The device allows the holding power and/or the seating pressure of the free end of the contact element to be increased in its closed end position.

11 Claims, 2 Drawing Sheets

ELECTRICAL SWITCHING DEVICE

This application claims Paris Convention Priority of German patent application 197 15 261.9 filed Apr. 12, 1997 the complete disclosure of which is hereby incorporated by reference.

BACKGROUND OF THE INVENTION

The present invention concerns a device for switching an electrical circuit with a contact element closing or opening the circuit between a first and a second terminal, one end of the contact element being connected to the first terminal in a conducting manner and its other free end closing the circuit in one end position of the contact element and opening the circuit in another end position, and having a switchable magnetic field, in particular one whose polarity can be changed, which moves the contact element via an actuator device into one of its two end positions.

A switching device of this kind has e.g. become known in the art through DE-GM 93 20 696.8.

In this conventional switching device, an electrical circuit can be closed or opened between two electrical terminals by means of a contact element resiliently borne at one end. The contact element is connected to a permanent magnet of an H-armature via a translating part, the H-armature being held in a pivotable manner at two yoke legs of a magnet coil. When the polarity of the magnet coil is changed, the permanent magnet pivots to push the translating element.

Since the translating element engages the contact element, same is thereby deflected out of its closed neutral position to interrupt the circuit. The free end of the contact element is thereby biased by a resilient element towards its closed end position.

The holding power of the contact element in its closed end position, i.e. the seating pressure of the free end of the closed contact element on the terminal is, in this conventional switching device, thereby determined by the strength of the permanent magnet and by the resilient element.

In contrast thereto, it is the purpose of the present invention to further improve a switching device of the above mentioned kind such that the holding force or the seating pressure of the free end of the contact element in its closed end position can be increased.

SUMMARY OF THE INVENTION

This purpose is achieved in accordance with the invention in that the actuating mechanism comprises a toggle lever by means of which the free end of the contact element can be moved into at least one of its two end positions.

In this switching device in accordance with the invention, a primary force effected by the magnetic field can be transformed by the toggle lever into a larger secondary force which e.g. can be utilized for the closing motion of the contact element while increasing the seating pressure of its free end on the terminal.

In a highly preferred embodiment, the toggle lever has a pivoting lever borne on the housing, a connecting arm cooperating with the magnetic field, and an actuator arm loading the contact element. When the polarity of the magnetic field is changed, the force which thereby acts on the connecting arm leads to an increased force on the actuator arm and the contact element in dependence on the lever and angle relationships of the toggle lever.

In an advantageous improvement of this embodiment, the connecting arm is connected to a permanent magnet. When the polarity of the magnetic field is changed, the permanent magnet moves with motion being transferred to the connecting arm. If the connecting arm is hinged to the permanent magnet, the connecting arm is restricted to exercise a linear translated motion in the housing.

In a highly preferred configuration of this improvement, a permanent magnet, which is preferably configured as part of an H-armature, is pivotably borne in the housing, e.g. between two yoke legs of a magnetic coil generating the magnetic field whose polarity can be changed.

Additional embodiments are particularly advantageous in which a resilient element, preferentially a resilient tongue, is provided on the contact element to cooperate with the toggle lever. Due to constructional tolerances, excessive forces occurring in the toggle lever cannot thereby directly act on the free end of the contact element, rather are accepted by the resilient element.

An additional preferred embodiment of the invention, the contact element can be connected to the second terminal via a plurality of, preferentially two, contacts.

A particularly preferred improvement in this embodiment provides that the plurality of contacts are resiliently borne on the contact element substantially independent of another. This has e.g. the advantage of reducing erosion of the contact surfaces due to premating contacting of the contacts. A resilient bearing of the plurality of contacts with different strengths can facilitate the adjustment of differing premating times.

In another advantageous improvement of the contacting, the contact element is disposed in an opening of the actuator arm, e.g. in a slot-shaped recess.

In a particular configuration of this improvement, each contact of the contact element can be associated with a separate opening of the actuator arm to, e.g. via the corresponding configuration of the opening, individually adjust the pressing force or the premating behavior of the contact.

It is particularly preferred when the contact element is configured as a leaf spring having at least one curved section protruding in a sideward direction out of the plane of the spring, wherein, for increased current strengths, a multi-layered leaf spring can be used.

The invention also concerns a double-switch for switching of two circuits having two switching devices in accordance with the invention which can be switched by a switchable magnet field, in particular by one whose polarity can be changed. By changing the polarity of the magnetic field, two circuits can be switched in such a fashion that the double-switch in accordance with the invention can e.g. be used as a two-phase relay.

In a particularly preferred embodiment of this double-switch device, both toggle levers of the two-switch device move in coupled cooperation with each other, preferentially in the same direction such that the two switching devices can e.g. be synchronously switched.

For example, the two toggle levers of the two switching devices can be coupled to each other via a common rigid connecting arm.

In order to make the double-switch in accordance with the invention as compact as possible, a highly preferred embodiment arranges the two switching devices, in particular their two contact elements, antiparallel to each other.

Instead of a double-switch having two switching devices, a multiple switch device can also be utilized in accordance with the invention with which a plurality of switching devices as described above can be operated via a magnetic field whose polarity can be changed.

Further advantages of the invention can be derived from the description and the drawing. The above mentioned features and those to be further described below can be utilized in accordance with the invention individually or collectively in arbitrary combination. The embodiments shown and described are not to be considered as exhaustive enumerations, rather have exemplary character only for illustration of the invention.

DESCRIPTION OF THE PREFERRED EMBODIMENT

Figure 1:
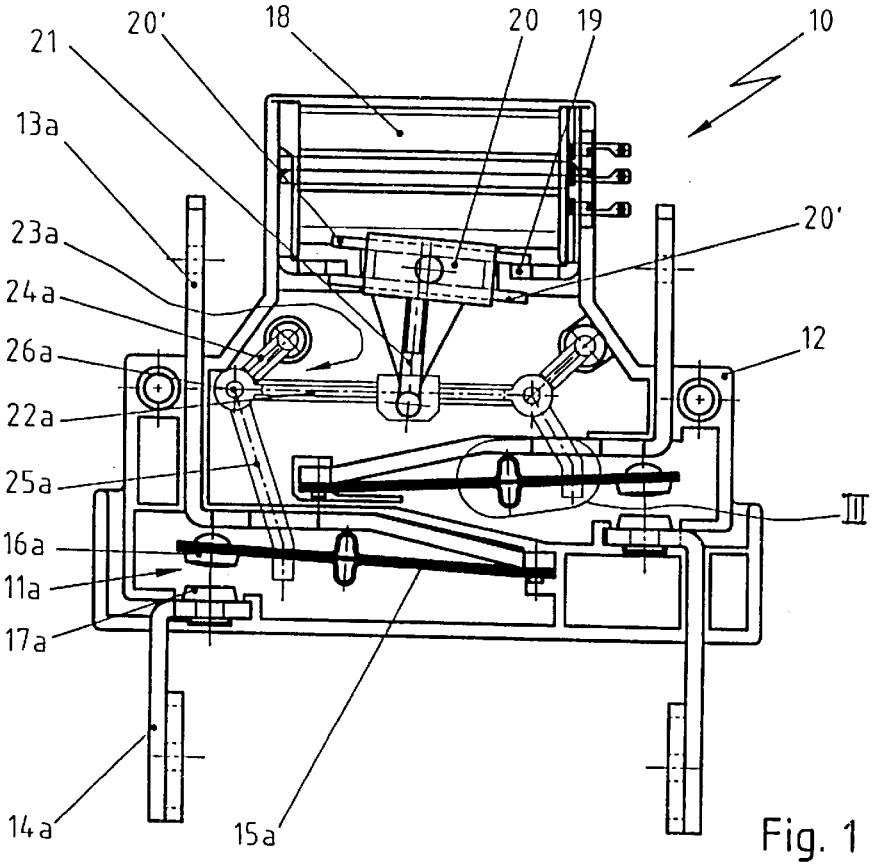
FIG. 1 shows an inside view of a double-switch device in accordance with the invention in an end position of two contact elements interrupting the circuit between both of the two terminals.
Figure 2:
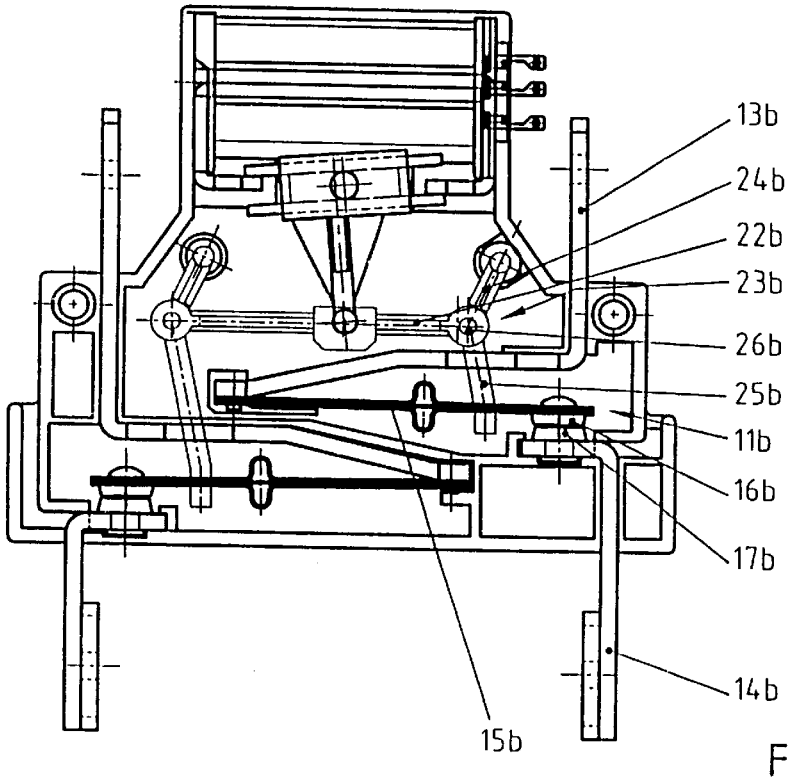
FIG. 2 shows a view corresponding to that of FIG. 1 in an end position of the two contact elements closing the circuit between both of the two terminals.

The double switch, designated in its entirety with 10 in FIG. 1, comprises two individual switching devices 11*a* and 11*b*, each component of which is designated only once in FIGS. 1 and 2 as a and b for reasons of clarity.

Two pairs of electrical terminals 13*a*, 14*a* and 13*b*, 14*b* are each disposed in a housing 12 between which a circuit can be closed or opened by means of the switching device 11*a*, 11*b*. A contact element 15*a* or 15*b* respectively, configured as a leaf spring, is connected in an electrically conducting fashion within the housing to a leg of the first terminal 13*a*, 13*b* in such a manner that its other free end is borne in a resilient fashion. The free end extends sufficiently far in the direction of a leg of the second terminal 14*a*, 14*b* disposed within the housing that a contact head 16*a*, 16*b*, disposed on the free end, has, in the closed end position, a plane parallel contact with a terminal head 17*a*, 17*b* on the second terminal 14*a*, 14*b*.

The opening and closing of the two circuits by the contact element 15*a*, 15*b* is triggered by the magnetic field of a magnetic coil 18 whose polarity can be changed and which has two yoke legs 19 on which a permanent magnet 20 is borne to pivot between armature plates 20'. The magnet coil 18 and the permanent magnet 20, pivotable between two pivot positions, form an H-armature.

Each arm 21 on permanent magnet 20 is hinged in a pivotable fashion to a connecting arm 22*a*, 22*b* which, at its other end, is connected to the contact element 15*a*, 15*b* via a toggle lever 23*a*, 23*b*. The toggle lever 23*a*, 23*b* has, in addition to the connecting arm 22*a*, 22*b*, a pivoting lever 24*a*, 24*b* borne on the housing 12 and an actuator arm 25*a*, 25*b* loading the contact element 15*a*, 15*b* all of which are connected to each other by means of a hinge 26*a*, 26*b*. In the embodiment shown, the two connecting arms 22*a*, 22*b* are configured as a common rigid connecting arm as a result of which the two contact element 15*a*, 15*b* are coupled to move together for synchronizing their switching motion.

In order to switch the double switch device 10, the polarity of the magnetic field of the magnet coil 18 is changed, whereby the permanent magnet 20 pivots e.g. from the pivot position shown in FIG. 1 into that shown in FIG. 2. This pivoting motion into the end position of the contact element 15*a*, 15*b* closing the circuit is transferred via arm 21 to the connecting arm 22*a*, 22*b* and thereafter, via the toggle lever 23*a*, 23*b* to the actuator arm 25*a*, 25*b* wherein, by means of the toggle lever, the force acting on the connecting arm 22*a*, 22*b* is amplified in dependence on the lever and angle relationships. The actuator arm 25*a*, 25*b* loading the contact element 15*a*, 15*b* swings the contact element 15*a*, 15*b* into its closed end position on the second terminal 14*a*, 14*b*, wherein, via the toggle lever 23*a*, 23*b*, an increased seating pressure or an increased holding force is effected. If the polarity of the magnetic field is changed, motion occurs in the opposite direction and the contact element 15*a*, 15*b* is released from its seating on the second terminal 14*a*, 14*b* to interrupt the circuit.

Alternative or in addition to the magnetic field of the magnet coil 18, the switch 10 in accordance with the invention can also be operated manually e.g. if the connecting arm 22*a*, 22*b* can be accessed and operated externally.

Figure 3:
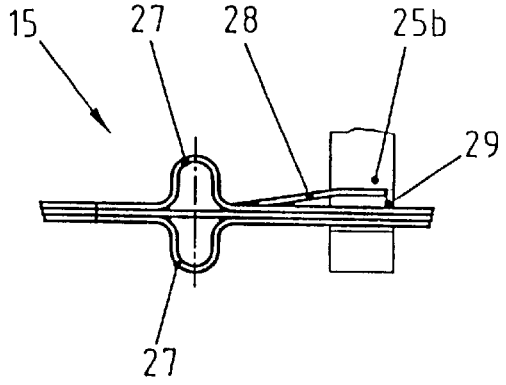
FIG. 3 shows a detail of the double-switch device of FIGS. 1 and 2 corresponding to III of FIG. 1.

In the embodiment shown in FIG. 3, the contact element 15 is a three-layered leaf spring each outer layer of which having a section 27 bent at right angles out of the plane of the leaf spring. In order to prevent excessive forces from acting on the contact elements 15*a*, 15*b* via the toggle lever 23*a*, 23*b* due to construction tolerances, the free end of the contact element 15*b* is borne in an opening 29 in the actuator arm 25*b* via a spring element 28 configured as a resilient tongue. Excessive forces do not thereby act directly on the free end of the contact element 15*b*, rather are accepted by the resilient element 28.

Figure 4:
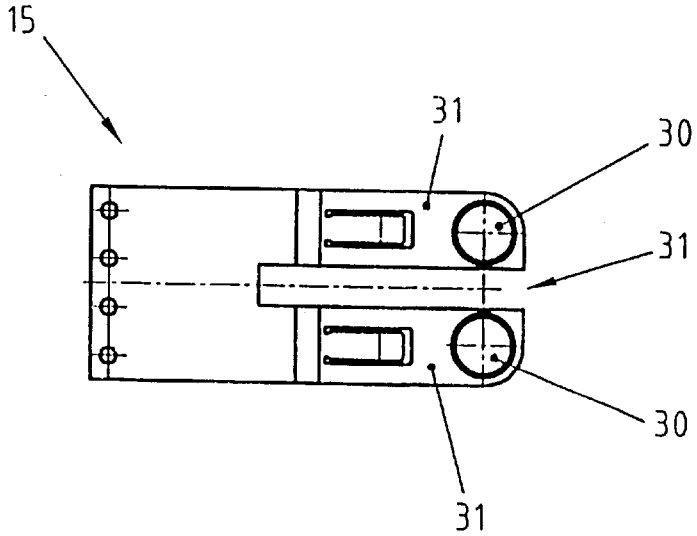
FIG. 4 shows an embodiment of a contact element having two contacts.

FIG. 4 shows an embodiment of a contact element 15 having two contacts 30 each configured as a contact head which cooperate with corresponding contact heads 17*a*, 17*b* on the second terminal 14*a*, 14*b*. The free ends 31 of the contact element 15 supporting the two contacts 30 are separated from each other via a longitudinal slot 31 and are thereby resiliently borne independently of each other. Since, when closing the switch, one of the two contacts 30 usually precedes the other due either to constructional tolerances or to intentional adjustment, this premating contacting can minimize erosion of the contact surfaces of the contacts 30.

Figure 5A:
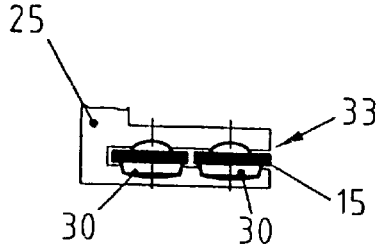
FIG. 5*a* shows a first embodiment of a configuration of a contact element on an actuator arm of a toggle lever.
Figure 5B:
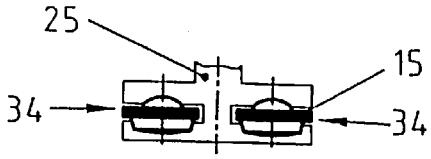
FIG. 5*b* shows a second embodiment of a configuration of a contact element on an actuator arm of a toggle lever.
Figure 5C:
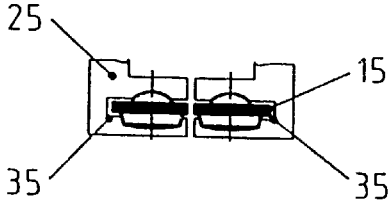
FIG. 5*c* shows a third embodiment of a configuration of a contact element on an actuator arm of a toggle lever.

Various embodiments for arrangement of a contact element 15 on an actuator arm 25 of a toggle lever are shown in FIGS. 5*a* to 5*c*. The free ends 30 of the contact element 15 are either commonly disposed in a recess opened at one side 33 (FIG. 5*a*) or disposed separately in two outwardly opening (FIG. 5*b*) or inwardly opening recesses (FIG. 5*c*) 34 and 35, respectively.

We claim:

1. A device for switching an electrical circuit, the device comprising:

a housing;

a magnet coil mounted to the housing, said magnet coil having a polarity which is changeable;

an armature seated at said magnet coil for pivoting in response to changes in said polarity, said armature having a bottom;

an armature arm having an upper end rigidly connected to said bottom of said armature, said armature arm extending away from said armature bottom in a downward direction, said armature arm having a lower end;

a first connecting arm extending in a substantially horizontal direction, said first connection arm having a first end connected to said lower end of said armature arm for pivoting motion relative thereto, said first connecting arm having a second end;

a first pivot lever having an upper end mounted to said housing for pivoting about a fixed first pivot point, said first pivot lever extending in a downward slanting direction away from said fixed pivot point, said first pivot lever having a lower end mounted to said second end of said first connecting arm for pivoting relative thereto;

a first actuator arm having an upper end mounted to said second end of said first connection arm for pivoting relative thereto, said first actuator arm extending in a downward slanting direction away from said upper end thereof, said first actuator arm having a lower end; and a first contact element communicating with said lower end of said first actuator arm, whereby a change in polarity of said magnet coil causes said armature and said armature arm to pivot, said first connecting arm to sidewardly displace, said first pivot lever to pivot in a downward direction to assume a more vertical orientation, said first actuator arm to pivot to assume a more vertical orientation and to displace said lower end thereof in a downward direction and press down said first contact element.

2. The device of claim 1, wherein said armature comprises a permanent magnet.

3. The device of claim 1, wherein said contact element comprises a resilient member having a first and a second end, said resilient member cooperating with said lower end of said actuator arm.

4. The device of claim 3, wherein said contact element has a first contact head borne on said first end of said resilient member.

5. The device of claim 4, further comprising a second contact head, borne on said first end of said resilient member, proximate said first contact head.

6. The device of claim 3, wherein said contact element comprises a first member connected to said second end of said resilient member and extending in a slanting direction above said resilient member, wherein said actuator arm has a first opening through which said first member passes.

7. The device of claim 3, wherein said resilient element comprises a leaf spring having a curved section protruding sidewardly out of a plane of said leaf spring.

8. The device of claim 1, further comprising:

a second connecting arm extending in a substantially horizontal direction away from said first connecting arm, said second connection arm having a first end connected to said lower end of said armature arm for pivoting motion relative thereto, said second connecting arm having a second end;

a second pivot lever having an upper end mounted to said housing for pivoting, about a fixed second pivot point, said second pivot lever extending in a downward slanting direction away from said fixed second pivot point, said second pivot lever having a lower end mounted to said second end of said second connecting arm for pivoting relative thereto;

a second actuator arm having an upper end mounted to said second end of said second connection arm for pivoting relative thereto, said second actuator arm extending in a downward slanting direction away from said upper end thereof, said second actuator arm having a lower end; and a second contact element communicating with said lower end of said second actuator arm, whereby a change in polarity of said magnet coil causes said armature and said armature arm to pivot, said second connecting arm to sidewardly displace, said second pivot lever to pivot in a downward direction to assume a more vertical orientation, said second actuator arm to pivot to assume a more vertical orientation and to displace said lower end thereof in a downward direction and press down said second contact element.

9. The device of claim 8, wherein said first connecting arm is mounted for moving together with said second connecting arm.

10. The device of claim 9, wherein said first and said second connecting arm comprise a common rigid connecting arm.

11. The device of claim 8, wherein said first contact element is antiparallel to said second contact element.

* * * * *